US006063264A

United States Patent [19]

Haritatos

[11] Patent Number: 6,063,264

[45] **Date of Patent: *May 16, 2000**

[54] ZEOLITE L CATALYST IN A FURNACE REACTOR

[75] Inventor: Nicholas J. Haritatos, El Cerrito, Calif.

[73] Assignee: Chevron Chemical Company LLC, San Francisco, Calif.

[ * ] Notice: This patent is subject to a terminal disclaimer.

[21] Appl. No.: 09/215,062

[22] Filed: Dec. 17, 1998

Related U.S. Application Data

[63] Continuation-in-part of application No. 08/995,587, Dec. 22, 1997, Pat. No. 5,879,538.

[51] Int. Cl.[7] ..... C10G 35/04; C10G 35/06

[52] U.S. Cl. ..... 208/137; 208/138; 208/134

[58] Field of Search ..... 208/137, 138, 208/134

[56] References Cited

U.S. PATENT DOCUMENTS

| | | | |
|---|---|---|---|
| 2,987,382 | 6/1961 | Endter et al. | 23/288 |
| 4,072,601 | 2/1978 | Patouillet | 208/134 |
| 4,098,587 | 7/1978 | Frar et al. | 48/94 |
| 4,104,320 | 8/1978 | Bernard et al. | 260/673 |
| 4,155,835 | 5/1979 | Antal | 208/89 |
| 4,161,510 | 7/1979 | Edridge | 422/197 |
| 4,434,311 | 2/1984 | Buss et al. | 585/444 |
| 4,435,283 | 3/1984 | Buss et al. | 208/138 |
| 4,447,316 | 5/1984 | Buss | 208/138 |
| 4,456,527 | 6/1984 | Buss et al. | 208/89 |
| 4,507,397 | 3/1985 | Buss | 502/38 |
| 4,517,306 | 5/1985 | Buss | 502/74 |
| 4,595,670 | 6/1986 | Tauster et al. | 502/74 |
| 4,664,620 | 5/1987 | Kendall et al. | 431/328 |
| 4,681,865 | 7/1987 | Katsuno et al. | 502/74 |
| 4,830,732 | 5/1989 | Mohr et al. | 208/138 |
| 4,973,778 | 11/1990 | Harandi et al. | 585/407 |
| 5,091,351 | 2/1992 | Murakawa et al. | 502/66 |
| 5,211,837 | 5/1993 | Russ et al. | 208/65 |
| 5,254,765 | 10/1993 | Martin et al. | 585/407 |
| 5,382,353 | 1/1995 | Mulaskey et al. | 208/138 |
| 5,525,311 | 6/1996 | Girod et al. | 422/200 |
| 5,565,009 | 10/1996 | Ruhl et al. | 48/197 R |
| 5,620,937 | 4/1997 | Mulaskey et al. | 502/66 |
| 5,674,376 | 10/1997 | Heyse et al. | 208/135 |
| 5,879,538 | 3/1999 | Haritatos | 208/137 |

FOREIGN PATENT DOCUMENTS

| | | |
|---|---|---|
| 201 856 | 11/1986 | European Pat. Off. . |
| 498 182 | 8/1992 | European Pat. Off. . |
| 512 912 | 11/1992 | European Pat. Off. . |
| 403 976 | 1/1995 | European Pat. Off. . |
| 2 116 450 | 9/1983 | United Kingdom . |

OTHER PUBLICATIONS

Fromager and Patouillet, "New Cat Reformer Design Tested", *Hydrocarbon Processing*, Apr. 1979.

Polk, "Evaluating Catalytic Reformer Heater Tubing After Extended High Temperature Service", *Corrosion/80*, Paper No. 50, Mar. 1980.

*Primary Examiner*—Walter D. Griffin
*Assistant Examiner*—Tam M. Nguyen
*Attorney, Agent, or Firm*—D. M. Tuck

[57] ABSTRACT

A process for catalytic reforming of feed hydrocarbons to form aromatics, comprising contacting the feed, under catalytic reforming conditions, with catalyst disposed in the tubes of a furnace, wherein the catalyst is a monofunctional, non-acidic catalyst and comprises a Group VIII metal and zeolite L, and wherein the furnace tubes are from 2 to 8 inches in inside diameter, and wherein the furnace tubes are heated, at least in part, by gas or oil burners located outside the furnace tubes.

24 Claims, 4 Drawing Sheets

X = Burner

O = Tube

ZEOLITE L CATALYST IN A FURNACE REACTOR

This patent application is a Continuation-in-Part patent application of U.S. Ser. No. 08/995,587, filed Dec. 22, 1997, now U.S. Pat. No. 5,879,538 the specification of which is incorporated herein by reference for all purposes.

FIELD OF THE INVENTION

The present invention relates to catalytic reforming using a catalyst comprising a non-acidic, monofunctional, large pore zeolite and a Group VIII metal having a low deactivation or fouling rate and high aromatics yield. More particularly, the present invention pertains to use of such catalyst in a gas or oil fired furnace.

BACKGROUND OF THE INVENTION

Reforming embraces several reactions, such as dehydrogenation, isomerization, dehydroisomerization, cyclization and dehydrocyclization. In the process of the present invention, aromatics are formed from the feed hydrocarbons to the reforming reaction zone, and dehydrocyclization is the most important reaction.

U.S. Pat. No. 4,104,320 to Bernard and Nury discloses that it is possible to dehydrocyclize paraffins to produce aromatics with high selectivity using a monofunctional non-acidic type-zeolite L catalyst. The zeolite L based catalyst in '320 has exchangeable cations of which at least 90% are sodium, lithium, potassium, rubidium or cesium, and contains at least one Group VIII noble metal (or tin or germanium). In particular, catalysts having platinum on potassium form L-zeolite exchanged with a rubidium or cesium salt were claimed by Bernard and Nury to achieve exceptionally high selectivity for n-hexane conversion to benzene. As disclosed in the Bernard and Nury patent, the zeolite L is typically synthesized in the potassium form. A portion, usually not more than 80%, of the potassium cations can be exchanged so that other cations replace the exchangeable potassium.

Later, a further important step forward was disclosed in U.S. Pat. Nos. 4,434,311; 4,435,283; 4,447,316; and 4,517,306 to Buss and Hughes. The Buss and Hughes patents describe catalysts comprising a large pore zeolite exchanged with an alkaline earth metal (barium, strontium or calcium, preferably barium) containing one or more Group VIII metals (preferably platinum) and their use in reforming petroleum naphthas. An essential element in the catalyst is the alkaline earth metal. Especially when the alkaline earth metal is barium, and the large-pore zeolite is L-zeolite, the catalysts were found to provide even higher selectivities than the corresponding alkali exchanged L-zeolite catalysts disclosed in U.S. Pat. No. 4,104,320.

These high selectivity catalysts of Bernard and Nury, and of Buss and Hughes, are all "non-acidic" and are referred to as "monofunctional catalysts". These catalysts are highly selective for forming aromatics via dehydrocyclization of paraffins.

Having discovered a highly selective catalyst, commercialization seemed promising. Unfortunately, that was not the case, because the high selectivity, L-zeolite catalysts did not achieve long enough run length to make them feasible for use in catalytic reforming. U.S. Pat. No. 4,456,527 discloses the surprising finding that if the sulfur content of the feed was reduced to ultra low levels, below levels used in the past for catalysts especially sensitive to sulfur, that then long run lengths could be achieved with the L-zeolite non-acidic catalyst. Specifically, it was found that the concentration of sulfur in the hydrocarbon feed to the L-zeolite catalyst should be at ultra low levels, preferably less than 100 parts per billion (ppb), more preferably less than 50 ppb, to achieve improved stability/activity for the catalyst used.

It was also found that zeolite L reforming catalysts are surprisingly sensitive to the presence of water, particularly while under reaction conditions. Water has been found to greatly accelerate the rate of deactivation of these catalysts. U.S. Pat. No. 4,830,732, which is herein incorporated by reference discloses the surprising sensitivity of zeolite L catalysts to water and ways to mitigate the problem. U.S. Pat. No. 5,382,353 and U.S. Pat. No. 5,620,937 to Mulaskey et al., which are herein incorporated by reference, disclose a zeolite L based reforming catalyst wherein the catalyst is treated at high temperature and low water content to thereby improve the stability of the catalyst, that is, to lower the deactivation rate of the catalyst under reforming conditions.

During commercialization of zeolite L reforming catalysts, it was found that the ultra low sulfur levels caused the unexpected problem of coking, carburization and metal dusting of the reactor system metallurgy. This problem has necessitated the use of special steels and/or steels having protective layers to prevent coking, carburization and metal dusting. When used, protective layers are provided on the steel surfaces that are to be contacted with hydrocarbons at process temperatures, e.g., at temperatures between about 800–1150° F. For example, a tin protective layer has been used in the reactors and furnace tubes of a catalytic reformer operated at ultra low sulfur levels. This has effectively reduced the rate of coke formation exterior to the catalyst particles in the reactors. Without this protection, coke buildup would have resulted in massive coke-plugging and in reactor system shutdowns. These problems are described in detail in Heyse et al., U.S. Pat. No. 5,674,376. Heyse et al, disclose the use of special steels and protective coatings, including tin coatings, to prevent carburization and metal dusting. In a preferred embodiment, Heyse et al., teach applying a tin paint to a steel portion of a reactor system and heating in hydrogen to produce a carburization-resistant intermetallic layer containing iron and nickel stannides. The reforming system of Heyse et al., is a high temperature, low sulfur and low water system that uses a conventional reformer designs, i.e., furnaces for heating the feed and catalysts located in conventional reactors.

Recently, several patents and patent applications of RAULO (Research Association for Utilization of Light Oil) and Idemitsu Kosan Co. have been published relating to use of halogen in zeolite L based monofunctional reforming catalysts. Such halogen containing monofunctional catalysts have been reported to have improved stability (catalyst life) when used in catalytic reforming, particularly in reforming feedstocks boiling above $C_7$ hydrocarbons in addition to C6 and C7 hydrocarbons. In this regard, see EP 201,856A; EP 498,182A; U.S. Pat. No. 4,681,865; and U.S. Pat. No. 5,091,351.

EP 403,976 to Yoneda et al., and assigned to RAULO, discloses the use of fluorine treated zeolite L based catalysts in small diameter tubes of about one-inch inside diameter (22.2 mm to 28 mm in the examples). Heating medium proposed for the small tubes were molten metal or molten salt so as to maintain precise control of the temperature of the tubes. Accordingly, EP 403,976 does not teach the use of a conventional type furnace or conventional type furnace tubes. Conventional furnaces for catalytic reforming have tubes of usually three or more inches in inside diameter (76 mm or more), whereas EP 403,976 teaches that using tubes having an inside diameter greater than 50 mm is undesirable. Also, conventional furnaces are heated using gas or oil fired burners.

Typical catalytic reforming processes employ a series of conventional furnaces to heat the naphtha feedstock before each reforming reactor stage, as the reforming reaction is endothermic. Thus, in a three-stage reforming process, the overall reforming unit would comprise a first furnace followed by a first-stage reactor vessel containing the reforming catalyst (over which catalyst the endothermic reforming reaction occurs); a second furnace followed by a second-stage reactor containing reforming catalyst over which the reforming reaction is further progressed; and a third furnace followed by a third-stage reactor with catalyst to further progress the reforming reaction conversion levels.

For example, U.S. Pat. No. 4,155,835 to Antal illustrates a three-stage reforming process, with three furnaces (30, 44, 52) and three reforming reactors (40, 48, 56) shown in the drawing in Antal. Example reforming reactors used according to the prior art arc shown, for instance, in U.S. Pat. No. 5,211,837 to Russ et al., particularly the radial flow reactor shown in FIG. 2 of Russ et al.

In some catalytic reforming units, as many as five or six stages of furnaces followed by reactors are used in series for the catalytic reforming unit. In particular, reforming of hydrocarbons over a Pt L zeolite catalyst is a highly endothermic reaction and can require as many as 5 or 6 stages or more of furnaces followed by reactors. The present invention allows such a multistage process to be greatly simplified to two, or more preferably one, furnace reactor.

SUMMARY OF THE INVENTION

According to a preferred embodiment of the present invention, a process for catalytic reforming of feed hydrocarbons is provided. The process comprises passing hydrocarbons over a catalyst comprising a Group VIII metal and a large pore zeolite disposed within a furnace, wherein said furnace comprises a first chamber and a second adjoining chamber separated by a heat exchange surface, wherein said catalyst is located within said first chamber and one or more burners are located within said second chamber. Preferably, the catalyst is no more than 4 inches from the heat exchange surface and at least a portion of the catalyst is more than one inch from the heat exchange surface.

A preferred embodiment of the process comprises contacting the feed, under catalytic reforming conditions, with catalyst disposed in the tubes of a furnace, wherein the catalyst is a monofunctional, non-acidic catalyst and comprises a Group VIII metal and zeolite L, and wherein the furnace tubes are from 2 to 8 inches in inside diameter, and wherein the furnace tubes are heated, at least in part, by gas or oil burners located outside the furnace tubes.

In a preferred embodiment of the present invention, the furnace can be basically a conventional type furnace, except that catalyst is disposed in the tubes of the furnace and the reactor metallurgy is constructed to avoid carburization and metal dusting problems caused by the low sulfur environment. The furnace is heated by conventional means for naphtha reforming units, such as by gas burners or oil burners. Also, in the present invention, the size of the tubes is conventional, in the range 2 to 8 inches, preferably 3 to 6 inches, more preferably 3 to 4 inches, in inside diameter. Monofunctional zeolite L based catalyst is contained inside the tubes of the conventional furnace in accordance with a particularly preferred embodiment of the present invention.

In a particularly preferred embodiment, the furnace tubes are made of a material having a resistance to carburization and metal dusting under low sulfur reforming conditions at least as great as that of type 347 stainless steel. The furnace tubes can be:

(a) made of type 347 stainless steel or a steel having a resistance to carburization and metal dusting at least as great as type 347 stainless steel; or (b) treated by a method comprising plating, cladding, painting or coating the furnace tube surfaces for contacting the feed to provide improved resistance to carburization and metal dusting; or (c) constructed of, or lined with, a ceramic material.

Among other factors, the present invention is based on my conception and unexpected finding that, using the catalysts defined herein, particularly non-acidic, monofunctional large pore zeolite based reforming catalyst, the conventional arrangement of furnaces and multi-stage reforming reactors can be coalesced into one or more stages of conventional furnaces, eliminating the reformer reactor vessels downstream of the furnace. In one embodiment of the present invention, the defined monofunctional reforming catalyst is disposed in the tubes of a conventional furnace. A preferred embodiment of the present invention is also based on my finding that a conventional multi-stage furnaces/reactors reforming arrangement (consisting of, for example, three to six, or as many as nine stages of furnaces and reactors) can be replaced by as few as one basically conventional furnace containing monofunctional zeolite L reforming catalyst in the tubes of the furnace. The present invention is also based on my discovery that zeolite catalysts of improved stability (i.e. having a deactivation rate of less than 0.04 degrees F per hour at reforming conditions) can be effectively and economically used in a furnace reactor for catalytic reforming. The improved stability of these catalysts further allows them to be used at operating conditions that enable long run lengths without frequent or continuous catalyst regeneration. My invention allows for simplified processing schemes and significantly less capital equipment than conventional catalytic reforming systems.

In an alternative embodiment of the present invention the furnace may be constructed such that the burners are located within tubes located in the furnace and the catalyst located in the area surrounding the tubes. The catalyst containing area may be a single chamber or a multitude of chambers. In such an arrangement it has been found that no portion of the catalyst should be more than 4 inches from the tube surface for heat flux reasons. Catalyst that is more than 4 inches from the heated surface may not be effective at dehydrocyclization of the hydrocarbons due to the highly endothermic nature of the dehydrocyclization reactions and the heat flux dependence on the distance from the burner tube or heat exchange surface. More preferably the catalyst should be no more than 3 inches from a burner tube surface. Still more preferably the catalyst should be no more than 2 inches from a burner tube surface. It has also been found that there is preferably one or more inches of catalyst packed around the burner tubes and more preferably 1.5 or more inches of catalyst packed around the burner tube surface. This reduces the amount of heat exchange surface in the furnace reactor and helps to minimize the number of furnace reactors required for reforming.

In still another embodiment of the present invention the furnace reactor comprises two or more chambers. One or more chambers contain burners. One or more adjoining chambers contain the catalyst. The burner chamber(s) and the adjoining catalyst chamber(s) are separated by a surface effective to provide heat exchange. This surface between the burner chamber(s) and the catalyst chambers is herein referred to as the heat exchange surface. The chambers may have a variety of shapes. It is important however that catalyst should preferably be no more than 4 inches from a heat exchange surface for heat flux reasons. Catalyst that is more than the preferred distance from the heated surface may not be effective at dehydrocyclization of the hydrocarbons due to the highly endothermic nature of the dehydrocyclization reactions and the heat flux dependence on the distance from the heat exchange surface. Thus catalyst that is more than 4 inches from the heat exchange surface may be effectively wasted. When I state that the catalyst is no more than an effective distance from the heat exchange surface to avoid wasting the catalyst it is meant that at least 80% of the catalyst be within that distance from the heat exchange surface, preferably at least 85% of the catalyst, more preferably at least 90%, still more preferably at least 95%, and most preferably essentially all of the catalyst is whithin the stated distance from the heat exchange surface. As stated above I have found that for the catalyst of the present invention, the catalyst should preferably be no more than 4 inches from the heat exchange surface. More preferably the catalyst should be no more than 3 inches from the heat exchange surface. Still more preferably the catalyst should be no more than 2 inches from the heat exchange surface. It has also been found that there is preferably more than one, and more preferably 1.5 or more, inches of catalyst packed around the heat exchange surface. This reduces the amount of heat exchange surface in the furnace reactor and helps to minimize the number of furnace reactors required for reforming.

As stated in the Background, U.S. Pat. No. 4,155,835 illustrates the use of a three-stage reforming unit comprising three conventional furnaces, and three reforming reactor vessels containing catalyst, with one reactor being located downstream of each of the three furnaces. In contrast, the present invention coalesces or collapses the furnaces and separate reactors into one or more furnace tubes reactor system, without the separate reactor vessels. According to the present invention, preferably, the system is only one furnace tube reactor, that is, coalescence to one furnace.

I have found that the present invention is particularly advantageously carried out at relatively low hydrogen to hydrocarbon feed mole ratios of 0.5 to 3.0, preferably 0.5 to 2.0, more preferably 1.0 to 2.0, most preferably 1.0 to 1.5, on a molar basis.

I have also found that in the process of the present invention high space velocities can be used. Preferred space velocities are from 1.0 to 7.0 volumes of feed per hour per volume of catalyst, more preferably 1.5 to 6 $hour^{-1}$, and still more preferably 3 to 5 $hour^{-1}$.

The relatively low hydrogen to hydrocarbon feed mole ratio and the high space velocities when using the present invention make it feasible to use less total catalyst and at a lower overall gas flow rate. These benefits in turn allow the use of a furnace reactor with a reasonable number of tubes.

Preferably, the Group VIII metals used in the catalyst disposed in the furnace tubes comprises platinum, palladium, iridium, and other Group VIII metals. Platinum is most preferred as the Group VIII metal in the catalyst used in the present invention.

Also, preferred catalysts for use in the present invention are non-acidic zeolite L catalysts, wherein exchangeable ions from the zeolite L, such as sodium and/or potassium, have been exchanged with alkali or alkaline earth metals. A particularly preferred catalyst is Pt Ba L zeolite, wherein the zeolite L has been exchanged using a barium containing solution. These catalysts are described in more detail in the Buss and Hughes references cited above in the Background section, which references are incorporated herein by reference, particularly as to description of Pt L zeolite catalyst.

According to another preferred embodiment of the present invention, the zeolite L based catalyst is produced by treatment in a gaseous environment in a temperature range between 1025° F. and 1275° F. while maintaining the water level in the effluent gas below 1000 ppm. Preferably, the high temperature treatment is carried out at a water level in the effluent gas below 200 ppm. Preferred high temperature treated catalysts are described in the Mulaskey et al. patents cited above in the Background section, which references are incorporated by reference herein, particularly as to description of high temperature treated Pt L zeolite catalysts.

According to another preferred embodiment of the present invention, the zeolite L based catalyst contains at least one halogen in an amount between 0.1 and 2.0 wt. % based on zeolite L. Preferably, the halogens are fluorine and chlorine and are present on the catalyst in an amount between 0.1 and 1.0 wt. % fluorine and 0.1 and 1.0 wt. % chlorine at the Start of Run. Preferred halogen containing catalysts are described in the RAULO and IKC patents cited above in the Background section, which references are incorporated by reference herein, particularly as to description of halogen containing Pt L zeolite catalysts. The above mentioned halogens may be added to the catalyst ex situ for example when the catalyst is made or may be added in situ, for instance at the start of the run. The preferred halogen contents of the catalyst mentioned above should preferably be present on the catalyst at the start of the run, when feed is introduced to the catalyst under reforming conditions.

Preferred feeds for the process of the present invention are naphtha boiling range hydrocarbons, that is, hydrocarbons boiling within the range of $C_6$ to $C_{10}$ paraffins and naphthenes, more preferably in the range of $C_6$ to $C_8$ paraffins and naphthenes, and most preferably of $C_6$ to $C_7$ paraffins and naphthenes. The feedstock can contain minor amounts of hydrocarbons boiling outside the specified range, such as 5 to 20%, preferably only 2 to 7% by weight. There are several different paraffins at each of the various carbon numbers. Accordingly, it will be understood that the boiling point has some range or variation at a given carbon number cut point. Typically, the paraffin rich feed is derived by fractionation of a petroleum crude oil.

In a preferred embodiment of the present invention, the feed contacting the catalyst preferably contains less than 50 ppb sulfur, more preferably less than 10 ppb sulfur. In the present invention, low catalyst rates are important. Ultra low sulfur in the feed contributes to the success of the present invention. Two patents that teach about the need to avoid sulfur poisoning of Pt L zeolite catalysts and teach how to achieve ultra low sulfur conditions are U.S. Pat. Nos. 4,456,527 and 5,322,615, which are herein incorporated by reference.

In one embodiment of the present invention, the furnace tubes are filled with catalyst, and a conventional furnace with its associated tubes are used as a combination heating means and catalytic reaction means.

In a particularly preferred embodiment of the present invention the catalyst is selected to have a particularly low deactivation rate under reforming conditions. Preferably, the catalyst selected for use and reaction conditions selected are such that the catalyst deactivation rate is controlled to less than 0.04° F. per hour, more preferably less than 0.03° F., still more preferably less than 0.02° F., and most preferably less than 0.01° F. per hour, at an aromatics yield of 50 wt % using a C6–C7 UDEX raffinate feed at a liquid hourly space velocity of 4 $hour^{-1}$ and a hydrogen to hydrocarbon mole ratio of 2. Utilizing a catalyst and conditions having the particularly preferred low deactivation rate allows for less catalyst to be used in the furnace reactor and allows the use of larger diameter tubes. In another embodiment of the invention that does not use tubes, the catalyst can be further away from a heat exchange surface than when using a catalyst that has a high deactivation rate. This in turn allows the total length of tubes or in the alternative embodiment the heat exchange surface area to be minimized and makes it economical to replace the multitude of furnace/reactor loops (usually 3–6 or more reactors in a conventional Pt L zeolite catalyst reformer) with a single furnace reactor.

The present invention may again be contrasted to U.S. Pat. No. 4,155,835 to Antal. The Antal reference uses reformer reactor vessels separate from the conventional furnaces, whereas the present invention does not.

Further, although the Antal process reduces the sulfur to very low sulfur levels in the feed, as low as 0.2 ppm sulfur, the present invention is preferably carried out at sulfur levels more than an order of magnitude lower, such as below 10 ppb sulfur, in the feed to the monofunctional zeolite L based catalyst contained in the furnace reactor system of the present invention.

Preferred reforming conditions for the furnace reactor of the present invention using the preferred catalyst comprising a monofunctional zeolite L include a LHSV between 1.5 and 6; a hydrogen to hydrocarbon ratio between 0.5 and 3.0; and a heat exchange surface temperature for the reactants (interior temperature) between 600° F. and 960° F. at the inlet and between 860° F. and 960° F. at the outlet at Start of Run (SOR), and between 600° F. and 1025° F. at the inlet and between 920° F. and 1025° F. at the outlet at End of Run (EOR). EOR is the time at which the run is ended usually due to deactivation of the catalyst. The catalyst of the present invention is considered at EOR at a point when the outlet temperature is no higher than 1025° F.

DETAILED DESCRIPTION OF THE DRAWINGS

Figure 1:
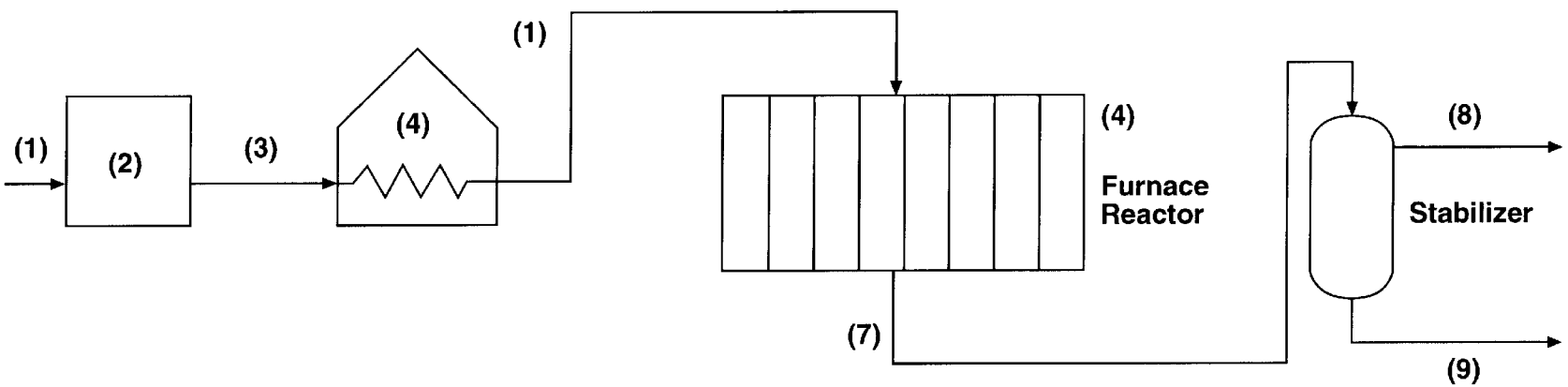
FIG. 1 is a schematic flow diagram for a furnace tube reactor system.

The drawing shown herein are for descriptive purposes only of possible embodiments of the invention and are not intended in any way to limit the invention.

FIG. 1 is a schematic flow diagram for a furnace tube reactor system. Hydrocarbon is fed to the unit through line (1). The sulfur content of the hydrocarbon is reduced to the desired low levels in the sulfur control unit (2). The hydrocarbon then goes via line (3) to an optional heat exchanger or preheater (4). The optionally heated effluent goes via line (5) to the furnace reactor (6) where it is simultaneously heated and contacted with the catalyst. The reactor effluent then goes via line (7) to a, stabilizer light gas is removed from the stabilizer by line (8) and liquid product leaves the stabilizer by line (9), which goes to product distillation (not shown).

Figure 2:
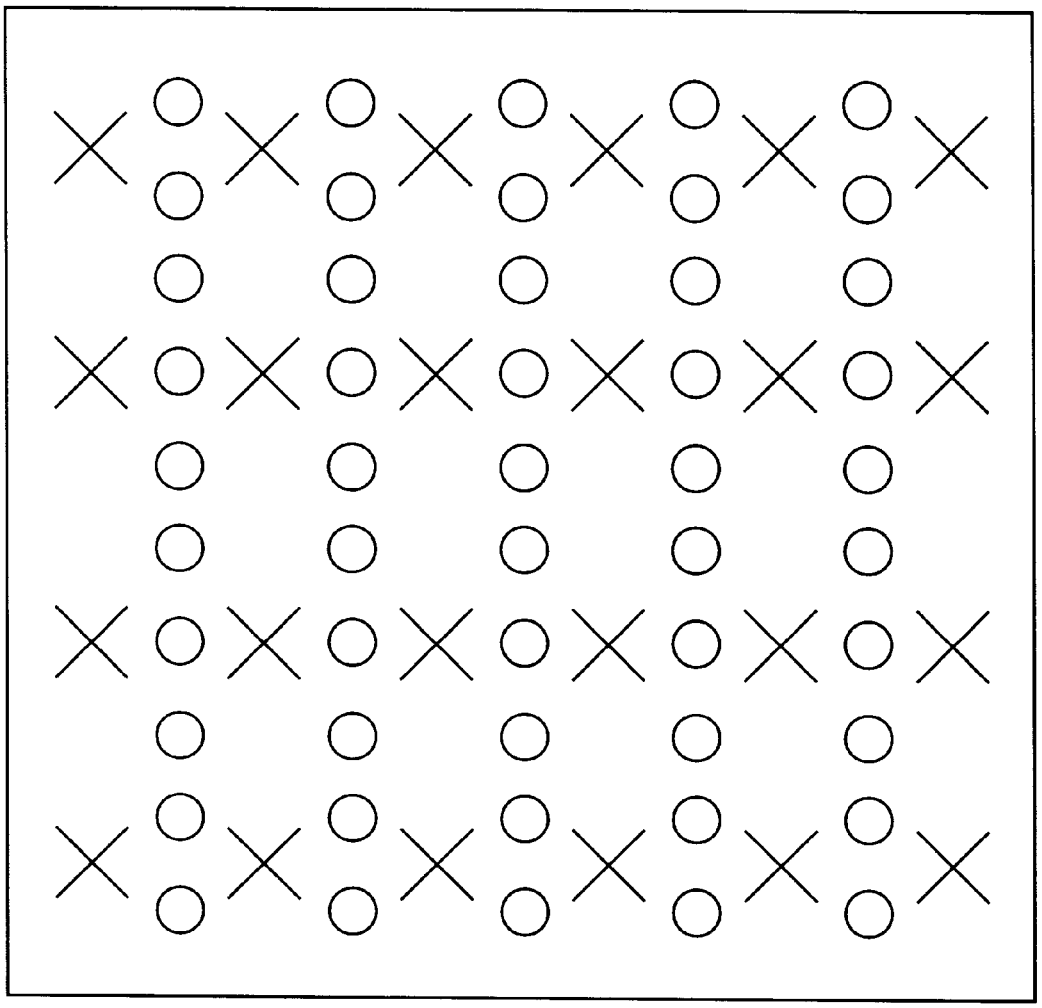
FIG. 2 is an overhead cross section view of a furnace tube reactor system showing the burners (X) and the reactor tubes (o).

FIG. 2 is an overhead cross section view of a furnace tube reactor system showing the burners (X) and the reactor tubes (o). The furnace tubes are filled with the catalyst. This is only one possible furnace tube arrangement.

Figure 3:
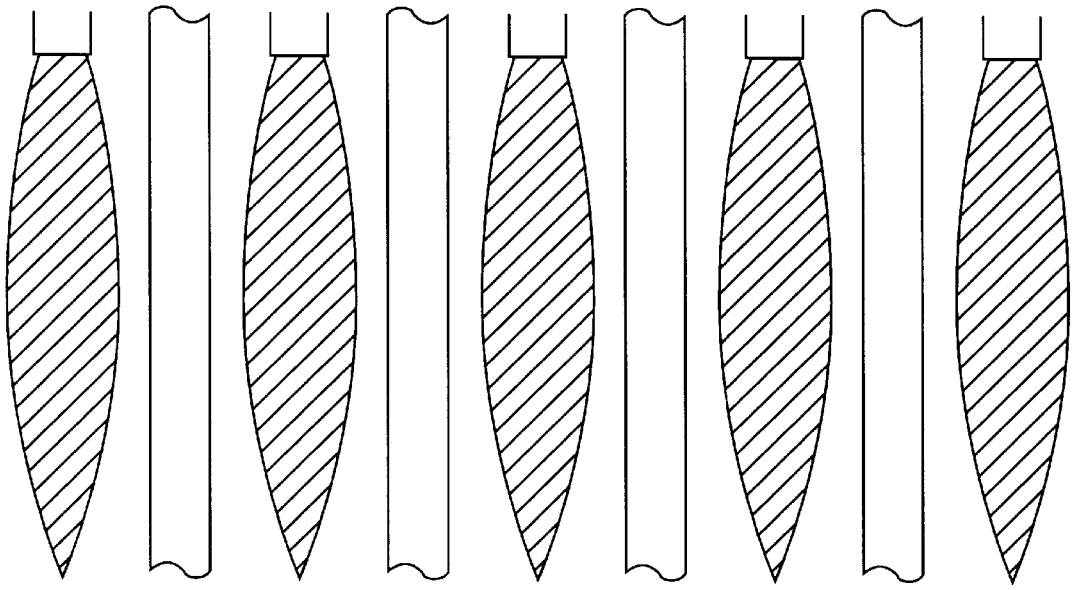
FIG. 3 is a simplified scheme showing a vertical cross-section with gas-fired heaters (shaded) adjacent to a parallel series of furnace tubes that contain catalyst.

FIG. 3 is a simplified scheme showing a vertical cross-section with gas-fired heaters (shaded) adjacent to a parallel series of furnace tubes that contain catalyst.

Figure 4:
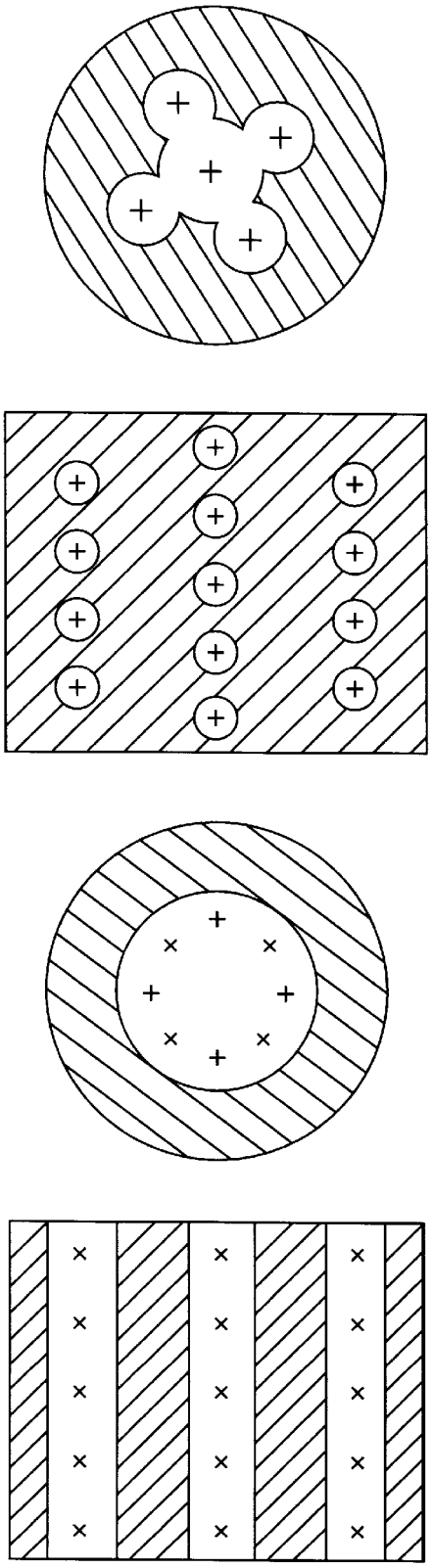
FIG. 4 shows 4 cross section views of alternative embodiment furnace reactor systems showing the burners (X) and the catalyst chamber or chambers as cross-hatched areas.

FIG. 4 shows 4 cross section views of alternative embodiment furnace reactor systems showing the burners (X) and the catalyst chamber or chambers as cross-hatched areas. There are numerous other possible furnace reactor configurations. The four arrangements in FIG. 4 are only meant as illustrations of possible embodiments of the chamber configurations useful in the present invention furnace reactor.

DETAILED DESCRIPTION OF THE INVENTION

The catalyst used in the process of the present invention comprises a Group VIII metal and zeolite L. The catalyst of the present invention is a non-acidic, monofunctional catalyst.

The Group VIII metal of the catalyst of the present invention preferably is a noble metal, such as platinum or palladium. Platinum is particularly preferred. Preferred amounts of platinum are 0.1 to 5 wt. %, more preferably 0.1 to 3 wt. %, and most preferably 0.3 to 1.5 wt. %, based on zeolite L.

In the present application the terms "L zeolite" and "zeolite L" are used synonymously to refer to LTL type zeolite. The zeolite L component of the catalyst is described in published literature, such as U.S. Pat. No. 3,216,789. The chemical formula for zeolite L may be represented as follows:

$$(0.9–1.3)\ M_{2/n}O:\ Al_2O_3\ (5.2–6.9)\ SiO_2:\ yH_2O$$

wherein M designates a cation, n represents the valence of M, and y may be any value from 0 to about 9. Zeolite L, its X-ray diffraction pattern, its properties, and method for its preparation are described in detail in U.S. Pat. No. 3,216,789. Zeolite L has been characterized in "Zeolite Molecular Sieves" by Donald W. Breck, John Wiley and Sons, 1974, (reprinted 1984) as having a framework comprising 18 tetrahedra unit cancrinite-type cages linked by double six rings in columns and cross-linked by single oxygen bridges to form planar 12-membered rings. The hydrocarbon sorption pores for zeolite L are reportedly approximately 7 Å in diameter. The Breck reference and U.S. Pat. No. 3,216,789 are incorporated herein by reference, particularly with respect to their disclosure of zeolite L.

The various zeolites are generally defined in terms of their X-ray diffraction patterns. Several factors have an effect on the X-ray diffraction pattern of a zeolite. Such factors include temperature, pressure, crystal size, impurities and type of cations present. For instance, as the crystal size of the type-L zeolite becomes smaller, the X-ray diffraction pattern becomes somewhat broader and less precise. Thus, the term "zeolite L" includes any of the various zeolites made of cancrinite cages having an X-ray diffraction pattern substantially the same as the X-ray diffraction patterns shown in U.S. Pat. No. 3,216,789. Type-L zeolites are conventionally synthesized in the potassium form, that is, in the theoretical formula previously given; most of the M cations are potassium. M cations are exchangeable so that a given type-L zeolite, for example, a type-L zeolite in the potassium form, can be used to obtain type-L zeolites containing other cations by subjecting the type-L zeolite to ion-exchange treatment in an aqueous solution of an appropriate salt or salts. However, it is difficult to exchange all the original cations, for example, potassium, since some cations in the zeolite are in sites that are difficult for the reagents to reach. Preferred L zeolites for use in the present invention are those synthesized in the potassium form. Preferably, the potassium form L zeolite is ion exchanged to replace a portion of the potassium, most preferably with an alkaline earth metal, barium being an especially preferred alkaline earth metal for this purpose as previously stated.

The catalysts used in the process of the present invention are monofunctional catalysts, meaning that they do not have the acidic function of conventional reforming catalysts. Traditional or conventional reforming catalysts are bifunctional, in that they have an acidic function and a metallic function. Examples of bifunctional catalysts 30 include platinum on acidic alumina as disclosed in U.S. Pat. No. 3,006,841 to Haensel; platinum-rhenium on acidic alumina as disclosed in U.S. Pat. No. 3,415,737 to Kluksdahl; platinum-tin on acidic alumina; and platinum-iridium with bismuth on an acidic carrier as disclosed in U.S. Pat. No. 3,878,089 to Wilhelm (see also the other acidic catalysts containing bismuth, cited above in the Background section).

Examples of monofunctional catalysts include platinum on zeolite L, wherein the zeolite L has been exchanged with an alkali metal, as disclosed in U.S. Pat. No. 4,104,320 to Bernard et al.; platinum on zeolite L, wherein the zeolite L has been exchanged with an alkaline earth metal, as disclosed in U.S. Pat. No. 4,634,518 to Buss and Hughes; platinum on zeolite L as disclosed in U.S. Pat. No. 4,456,527 to Buss, Field and Robinson; and platinum on halogenated zeolite L as disclosed in the RAULO and IKC patents cited above.

According to another embodiment of the present invention, the catalyst is a high temperature reduced or activated (HTR) catalyst.

Preferably, the pretreatment process used on the catalyst occurs in the presence of a reducing gas such as hydrogen, as described in U.S. Pat. No. 5,382,353 issued Jan. 17, 1995,and U.S. patent application Ser. No. 08/475,821, which are hereby expressly incorporated by reference in their entirety. Generally, the contacting occurs at a pressure of from 0 to 300 psig and a temperature of from 1025° F. to 1275° F. for from 1 hour to 120 hours, more preferably for at least 2 hours, and most preferably for at least 4–48 hours. More preferably, the temperature is from 1050° F. to 1250° F. In general, the length of time for the pretreatment will be somewhat dependent upon the final treatment temperature, with the higher the final temperature the shorter the treatment time that is needed.

For a commercial size plant, it is necessary to limit the moisture content of the environment during the high temperature treatment in order to prevent significant catalyst deactivation. In the temperature range of from 1025° F. to 1275° F., the presence of moisture is believed to have a severely detrimental effect on the catalyst activity. It has therefore been found necessary to limit the moisture content of the environment to as little water as possible during said treatment period, to at least less than 200 ppmv, preferably less than 100 ppmv water.

In one embodiment, in order to limit exposure of the catalyst to water vapor at high temperatures, it is preferred that the catalyst be reduced initially at a temperature between 300° F. and 700° F. After most of the water generated during catalyst reduction has evolved from the catalyst, the temperature is raised slowly in ramping or 5 stepwise fashion to a maximum temperature between 1025° F. and 1250° F.

The temperature program and gas flow rates should be selected to limit water vapor levels in the reactor effluent to less than 200 ppmv and, preferably, less than 100 ppmv when the catalyst bed temperature exceeds 1025° F. The rate of temperature increase to the final activation temperature will typically average between 5 and 50° F. per hour. Generally, the catalyst will be heated at a rate between 10 and 25° F. per hour. It is preferred that the gas flow through the catalyst bed during this process exceed 500 volumes per volume of catalyst per hour, where the gas flow volume is measured at standard conditions of one atmosphere and 60° F. In other words, the gas flow volume is greater than 500 gas hourly space volume (GHSV). GHSVs in excess of 5000 per hour will normally exceed the compressor capacity. GHSVs between 600 and 2000 per hour are most preferred.

The pretreatment process occurs prior to contacting the reforming catalyst with a hydrocarbon feed. The large-pore zeolitic catalyst is generally treated in a reducing atmosphere in the temperature range of from 1025° F. to 1275° F. Although other reducing gasses can be used, dry hydrogen is preferred as a reducing gas. The hydrogen is generally mixed with an inert gas such as nitrogen, with the amount of hydrogen in the mixture generally ranging from 1% to 99% by volume. More typically, however, the amount of hydrogen in the mixture ranges from about 10 to 50% by volume.

In another embodiment, the catalyst can be pretreated using an inert gaseous environment in the temperature range of from 1025–1275° F., as described in U.S. patent application Ser. No. 08/450,697, filed May 25, 1995, which is hereby expressly incorporated by reference in its entirety.

The preferred inert gas is nitrogen, for reasons of availability and cost. Other inert gases, however, can be used such as helium, argon, and krypton or mixtures thereof.

According to an especially preferred embodiment of the present invention, the non-acidic, monofunctional catalyst used in the process of the present invention contains a halogen. This may be confusing at first, in that halogens are often used to contribute to the acidity of alumina supports for acidic, bifunctional reforming catalysts. However, the use of halogens with catalysts based on zeolite L can be made while retaining the non-acidic, monofunctional characteristic of the catalyst. Methods for making non-acidic halogen containing zeolite L based catalysts are disclosed in the RAULO and IKC references cited above in the Background section.

The term "non-acidic" is understood by those skilled in this area of art, particularly by the contrast between monofunctional (non-acidic) reforming catalysts and bifunctional (acidic) reforming catalysts. One method of achieving non-acidity is by the presence of alkali and/or alkaline earth metals in the zeolite L, and preferably is achieved, along with other enhancement of the catalyst, by exchanging cations such as sodium and/or potassium from the synthesized L zeolite using alkali or alkaline earth metals. Preferred alkali or alkaline earth metals for such exchanging include potassium and barium.

The term "non-acidic" also connotes high selectivity of the catalyst for conversion of aliphatics, especially paraffins, to aromatics, especially benzene, toluene and/or xylenes. High selectivity includes at least 30% selectivity for aromatics formation, preferably 40%, more preferably 50%. Selectivity is the percent of the conversion that goes to aromatics, especially to BTX (Benzene, Toluene, Xylene) aromatics when feeding a $C_6$ to $C_8$ aliphatic feed.

Preferred feeds to the process of the present invention are $C_6$ to $C_9$ naphthas. The catalyst of the present invention has an advantage with paraffinic feeds, which normally give poor aromatics yields with conventional bifunctional reforming catalysts. However, naphthenic feeds are also readily converted to aromatics over the catalyst of the present invention.

More preferably, feeds to the process of the present invention are $C_6$ to $C_7$ naphthas. The furnace reactor system of the present invention is particularly advantageously applied to converting $C_6$ and $C_7$ naphthas to aromatics.

Particularly preferred catalytic reforming conditions for the present invention include, as described above under Summary of the Invention, an LHSV between 1.5 and $6.0^{-1}$, a hydrogen to hydrocarbon ratio between 0.5 and 2.0, a reactants temperature between 600° F. and 1025° F., and an outlet pressure between 35 and 75 psig.

Preferably, the catalyst used in the process of the present invention is bound. Binding the catalyst improves its crush strength, compared to a non-bound catalyst comprising platinum on zeolite L powder. Preferred binders for the catalyst of the present invention are alumina or silica. Silica is especially preferred for the catalyst used in the present invention. Preferred amounts of binder are from 5 to 90 wt. % of the finished catalyst, more preferably from 10 to 50 wt. %, and still more preferably from 10to 30wt. %.

As the catalyst may be bound or unbound, the weight percentages given herein are based on the zeolite L component of the catalyst, unless otherwise indicated.

The term "catalyst" is used herein in a broad sense to include the final catalyst as well as precursors of the final catalyst. Precursors of the final catalyst include, for example, the unbound form of the catalyst and also the catalyst prior to final activation by reduction. The term "catalyst" is thus used to refer to the activated catalyst in some contexts herein, and in other contexts to refer to precursor forms of the catalyst, as will be understood by skilled persons from the context.

Also with regard to use of the halogenated form of the monofunctional catalyst in the present invention, the percent halogen in the catalyst is that at Start of Run (SOR). During the course of the run or use of the catalyst, some of the halogen usually is lost from the catalyst.

A preferred embodiment furnace tube reactor system of the present invention refers to a reforming system in which non-acidic, highly selective zeolite L based catalyst is contained within a plurality of conventional furnace tubes which are themselves contained within a furnace. See FIG. 1 which shows a schematic diagram of a furnace reactor reforming process.

The furnace tubes are preferably parallel to each other and are preferably vertically arranged. Typically, rows of furnace tubes alternate with rows of burners. FIGS. 2 and 3 show a suitable arrangement for the burners and furnace tubes. FIG. 2 shows a horizontal cross section of the preferred embodiment furnace reactor where the Xs designate burners and the Os designate tubes. FIG. 3 shows a longitudinal view of the preferred embodiment furnace tube reactor where the burners are shown impinging down parallel to the tubes.

The tubes are preferably 2 to 8 inches in diameter, more preferably 3 to 6 inches in diameter, and most preferably 3 to 4 inches in diameter, and can be up to 45 feet long. The furnace tubes are preferably less than or equal to 30 feet long and preferably are at least 10 feet long. The arrangement of the furnace tubes and the burners can vary. Thus the furnace tubes can be positioned vertically, or horizonontally, or in an arbor coil arrangement or in a helical coil arrangement. The burners can likewise be oriented in a number of different ways, for instance at the bottom of the furnace pointing up or at the side of the furnace pointing horizontally. Preferably the furnace tubes are positioned vertically with the burners pointed down parallel to the tubes.

Furnace reactors can be linked in series or in parallel, but preferably the system is designed so that a single furnace reactor is used. Replacement of the 3 to 6 or more conventional reforming reactors and furnace loops in a Pt L zeolite reformer with a single furnace reactor is preferable and is feasible with a Pt L zeolite catalyst having a high activity and a low deactivation rate. We have found that replacement of a multitude of conventional reactors and furnace loops results in greatly reduced investment costs for a Pt L zeolite reformer.

In a preferred embodiment, utilizing vertical tubes filled with catalyst, the feed comes in at the top of the tubes. The burners are mounted in the roof of the furnace and fire down into the firebox. The maximum heat flux would then be at the point where feed is coming into the furnace tubes, which is desirable. Alternatively, a multi-zone furnace can be used. Here the heat flux can be varied more controllably. The heat flux supplied to the reactor inlets is preferably greater than that applied near the reactor outlet.

It is desirable that the furnace tube surfaces or the heat exchange surfaces that contact the hydrocarbons and resulting aromatics are made of a material having a resistance to carburization and metal dusting at least as great as that of type 347 stainless steel under low sulfur reforming conditions. The resistance to carburization and metal dusting can be readily determined using the procedure outlined below in Example 4.

In a preferred embodiment of the invention, the furnace tube reactors are made of (a) 347 stainless steel or a steel having a resistance to carburization and metal dusting at least as great as 347 stainless steel; or (b) the furnace tubes are treated by a method comprising plating, cladding, painting or coating the surfaces for contacting the feed to provide improved resistance to carburization and metal dusting; or (c) the furnace tubes are constructed of or lined with a ceramic material. More preferably the furnace tubes are constructed of a type 300 series steel provided with an intermetallic coating on the surfaces that contact hydrocarbons.

In one embodiment of the invention, the furnace tubes have a metal-containing coating, cladding, plating, or paint applied to at least a portion (preferably at least 50%, more preferably at least 75% and most preferably to all) of the surface area that is to be contacted with hydrocarbons at conversion temperature. After coating, the metal-coated reactor system is preferably heated to produce intermetallic and/or metal carbide layers. A preferred metal-coated reactor system preferably comprises a base construction material (such as a carbon steel, a chromium steel, or a stainless steel) having one or more adherent metallic layers attached thereto. Examples of metallic layers include elemental chromium and iron-tin intermetallic compounds such as $FeSn_2$.

As used herein, the term "metal-containing coating" or "coating" is intended to include claddings, platings, paints and other coatings that contain either elemental metals, metal oxides, organometallic compounds, metal alloys, mixtures of these components and the like. The metal(s) or metal compounds are preferably a key component(s) of the coating. Flowable paints that can be sprayed or brushed are a preferred type of coating. In a preferred embodiment, the coated steel is heat treated to produce intermetallic compounds, thus reacting the coating metal with the steel.

Especially preferred are metals that interact with, and preferably react with, the base material of the reactor system to produce a continuous and adherent metallic protective layer at temperatures below or at the intended hydrocarbon conversion conditions. Metals that melt below or at reforming process conditions are especially preferred as they can more readily provide complete coverage of the substrate material. These metals include those selected from among tin, antimony, germanium, arsenic, bismuth, aluminum, gallium, indium, copper, lead, and mixtures, intermetallic compounds and alloys thereof. Preferred metal-containing coatings comprise metals selected from the group consisting of tin, antimony, germanium, arsenic, bismuth, aluminum, and mixtures, intermetallic compounds and alloys of these metals. Especially preferred coatings include tin-, antimony- and germanium-containing coatings. These metals will form continuous and adherent protective layers. Tin coatings are especially preferred—they are easy to apply to steel, are inexpensive and are environmentally benign.

It is preferred that the coatings be sufficiently thick that they completely cover the base metallurgy and that the resulting protective layers remain intact over years of operation. For example, tin paints may be applied to a (wet) thickness of between 1 to 6 mils, preferably between about 2 to 4 mils. In general, the thickness after curing is preferably between about 0.1 to 50 mils, more preferably between about 0.5 to 10 mils.

Metal-containing coatings can be applied in a variety of ways, which are well known in the art, such as electroplating, chemical vapor deposition, and sputtering, to name just a few. Preferred methods of applying coatings include painting and plating. Where practical, it is preferred that the coating be applied in a paint-like formulation (hereinafter "paint"). Such a paint can be sprayed, brushed, pigged, etc. on reactor system surfaces.

One preferred protective layer is prepared from a metal-containing paint. Preferably, the paint comprises or produces a reactive metal that interacts with the steel. Tin is a preferred metal and is exemplified herein; disclosures herein about tin are generally applicable to other metals such as germanium. Preferred paints comprise a metal component selected from the group consisting of: a hydrogen decomposable metal compound such as an organometallic compound, finely divided metal and a metal oxide, preferably a metal oxide that can be reduced at process or furnace tube temperatures In a preferred embodiment the cure step produces a metallic protective layer bonded to the steel through an intermediate bonding layer, for example a carbide-rich bonding layer, as described in U.S. Pat. No. 5,674,376, which is incorporated herein by reference in its entirety. This patent also describes useful coatings and paint formulations.

Tin protective layers are especially preferred. For example, a tin paint may be used. A preferred paint contains at least four components or their functional equivalents: (i) a hydrogen decomposable tin compound, (ii) a solvent system, (iii) finely divided tin metal and (iv) tin oxide. As the hydrogen decomposable tin compound, organometallic compounds such as tin octanoate or neodecanoate are particularly useful. Component (iv), the tin oxide is a porous tin-containing compound that can sponge-up the organometallic tin compound, and can be reduced to metallic tin. The paints preferably contain finely divided solids to minimize settling. Finely divided tin metal, component (iii) above, is also added to insure that metallic tin is available to react with the surface to be coated at as low a temperature as possible. The particle size of the tin is preferably small, for example one to five microns. Tin forms metallic stannides (e.g., iron stannides and nickel/iron stannides) when heated under reducing conditions, e.g. in the presence of hydrogen.

In one embodiment, there can be used a tin paint containing stannic oxide, tin metal powder, isopropyl alcohol and 20% Tin Ten-Cem (manufactured by Mooney Chemical Inc., Cleveland, Ohio). Twenty percent Tin Ten-Cem contains 20% tin as stannous octanoate in octanoic acid or stannous neodecanoate in neodecanoic acid. When tin paints are applied at appropriate thicknesses, heating under reducing conditions will result in tin migrating to cover small regions (e.g., welds) that were not painted. This will completely coat the base metal.

Additional information on the composition of tin protective layers is disclosed in U.S. Pat. No. 5,406,014 to Heyse et al., which is incorporated herein by reference. Here it is taught that a double layer is formed when tin is coated on a chromium-rich, nickel-containing steel. Both an inner chromium-rich layer and an outer stannide layer are produced. The outer layer contains nickel stannides. When a tin paint was applied to a 304 type stainless steel and heated at about 1200° F., there resulted a chromium-rich steel layer containing about 17% chromium and substantially no nickel, comparable to 430 grade stainless steel.

Tin/iron paints are also useful in the present invention. A preferred tin/iron paint will contain various tin compounds to which iron has been added in amounts up to one third Fe/Sn by weight. The addition of iron can, for example, be in the form of $Fe_2O_3$. The addition of iron to a tin containing paint should afford noteworthy advantages; in particular: (i) it should facilitate the reaction of the paint to form iron stannides thereby acting as a flux; (ii) it should dilute the nickel concentration in the stannide layer thereby providing a coating having better protection against coking; and (iii) it should result in a paint that affords the anti-coking protection of iron stannides even if the underlying surface does not react well.

Some of the coatings, such as the tin paint described above, are preferably cured, for example, by heat treatment. Cure conditions depend on the particular metal coating and curing conditions that are selected so as to produce an adherent protective layer. Gas flow rates and contacting time depend on the cure temperature used, the coating metal and the specific components of the coating composition.

The coated materials are preferably cured in the absence of oxygen. If they are not already in the metallic state, they are preferably cured in a reducing atmosphere, preferably a hydrogen-containing atmosphere, at elevated temperatures. Cure conditions depend on the coating metal and are selected so they produce a continuous and uninterrupted protective layer that adheres to the steel substrate. The resulting protective layer is able to withstand repeated temperature cycling, and does not degrade in the reaction environment. Preferred protective layers are also useful in reactor systems that are subjected to oxidizing environments, such as those associated with coke burn-off.

In general, the contacting of the reactor system having a metal-containing coating, plating, cladding, paint or other coating applied to a portion thereof with hydrogen is done for a time and at a temperature sufficient to produce a metallic protective layer. These conditions may be readily determined. For example, coated coupons may be heated in the presence of hydrogen in a simple test apparatus; the formation of the protective layer may be determined using petrographic analysis.

It is preferred that cure conditions result in a protective layer that is firmly bonded to the steel. This may be accomplished, for example, by curing the applied coating at elevated temperatures. Metal or metal compounds contained in the paint, plating, cladding or other coating are preferably cured under conditions effective to produce molten metals and/or compounds. Thus, germanium and antimony paints are preferably cured between 1000° F. and 1400° F. Tin paints are preferably cured between 900° F. and 1100° F. Curing is preferably done over a period of hours, often with temperatures increasing over time. The presence of hydrogen is especially advantageous when the paint contains reducible oxides and/or oxygen-containing organometallic compounds.

As an example of a suitable paint cure for a tin paint, the system including painted portions can be pressurized with flowing nitrogen, followed by the addition of a hydrogen-containing stream. The reactor inlet temperature can be raised to 800° F. at a rate of 50–100° F./hr. Thereafter the temperature can be raised to a level of 950–975° F. at a rate of 50° F./hr, and held within that range for about 48 hours.

The Furnace Tube Construction Material

There are a wide variety of base construction materials that can be used in the furnace tubes or the heat exchange surfaces. If the tubes/surfaces are to be protected with a metallic coating, then a wide range of steels may be used. In general, steels are chosen so that they meet the strength and flexibility requirements for the catalytic reforming process. These requirements are well known in the art and depend on process conditions, such as operating temperatures and pressures.

Useful steels include carbon steel; low alloy steels such as 1.25, 2.5, 5, 7, and 9 chrome steel; 300 series stainless steels including 304, 316 and 346; heat resistant steels including HK-40 and HP-50, as well as treated steels such as aluminized or chromized steels. Preferred steels include the 300 series stainless steels and heat resistant steels.

Depending on the components of the metal-containing coating, reaction of the steel with the coating can occur. Preferably, the reaction results in an intermediate carbide-rich bonding or "glue" layer that is anchored to the steel and does not readily peel or flake. For example, metallic tin, germanium and antimony (whether applied directly as a plating or cladding or produced in-situ) readily react with steel at elevated temperatures to form a bonding layer as is described in U.S. Pat. No. 5,406,014 or WO 94/15896, both to Heyse et al. The '014 patent is incorporated herein by reference in its entirety.

If the tubes/surfaces are not to be protected with a metallic coating, they can be protected against carburization and metal dusting with a ceramic coating. These types of coatings are well known in the art. See U.S. Pat. No. 4,161,510.

The furnace tube reactors may also be constructed of uncoated steels, so long as the steels have a resistance to carburization and metal dusting at least as great as 347 stainless steel under low sulfur reforming conditions. See Example 4 below. Useful steels include the 300 series stainless steels including type 304, 316 and 347 stainless steels; heat resistant steels including HK-40 and HP-50, as well as treated steels such as aluminized or chromized steels.

As stated earlier, I have also found that in the process of the present invention high space velocities are advantageously used. Relatively high space velocities allow lower total tube volume to be used. Lower space rates conversely require more tube volume to contain the appropriate (desired) amount of catalyst and thus may be less desirable, particularly if the total furnace size must be significantly larger to accommodate the increased volume of tubes.

The diameter and length of the furnace tubes can be varied so that a desired pressure drop and heat flux across the tubes is attained. The length and diameter of the furnace tubes, and the location and number of burners, allow for regulation of the skin temperature of the furnace tubes as well as the radial and axial temperature profile of the furnace tubes. These parameters can be designed to allow for appropriate conversion of particular feeds. However, the concept of the present invention requires that the furnace be basically conventional. Accordingly, the size of the furnace tubes will be at least two inches in inside diameter, more preferably at least three inches in inside diameter. Also, the furnace will be heated by conventional means, such as by gas or oil fired burners.

The pressure drop across the length of the furnace tubes preferably is less than or equal to 70 psi, more preferably less than 60 psi, most preferably less than 50 psi. The outlet pressure is preferably between 25 and 100 psig, more preferably between 35 and 75 psig, and most preferably between 40 and 50 psig. The outlet pressure is the reaction mixture pressure at the outlet of the furnace tubes, that is, as the tubes and contained reaction mixture come out of the furnace.

To obtain a more complete understanding of the present invention, the following examples illustrating certain aspects of the invention are set forth. It should be understood, however, that the invention is not intended to be limited in any way to the specific details of the examples.

EXAMPLES

Example 1

This example compares a conventional adiabatic multi-stage reactor system to the externally heated furnace tube reactor of the present invention. The catalyst used in this comparison is platinum on halogenated zeolite L as disclosed in the RAULO and IKC patents cited earlier. The total volume of catalyst in the two systems is the same. The same light naphtha is used as feed to both reactor systems. The light naphtha feed contained 2 percent $C_5$'s, 90 percent $C_6$'s (primarily paraffins but also minor amounts of naphthenes), and 8 percent by volume $C_7$'s. The conditions and parameters in the example have been adjusted to give the same total run length for the two systems in the comparison.

| | Externally heated furnace tube | Adiabatic multi-stage reactor system | | | | | |
|---|---|---|---|---|---|---|---|
| | reactor | 1st | 2nd | 3rd | 4th | 5th | 6th |
| Tube inner diameter, inches | 3 | | | | | | |
| Number of tubes | 800 | | | | | | |
| Tube length, feet | 15 | | | | | | |
| Catalyst volume, cubic feet | 580 | 60 | 60 | 60 | 115 | 115 | 170 |
| Temperature at reactor inlet, ° F. | 900 | 945 | 950 | 955 | 960 | 965 | 970 |
| Inlet pressure, psig | 85 | | | 85 | | | |
| Outlet pressure | 45 | | | 45 | | | |
| Liquid Hourly Space Velocity, (1/hr.) | 4 | | | 4 | | | |
| Feed | Light naphtha | | | Light naphtha | | | |
| $H_2$/Hydrocarbon mole ratio | 1 | | | 1 | | | |
| $C_5$+ yield, wt. % of feed | 83.4 | | | 89.6 | | | |

-continued

| | Externally heated furnace tube | Adiabatic multi-stage reactor system | | | | | |
|---|---|---|---|---|---|---|---|
| | reactor | 1st | 2nd | 3rd | 4th | 5th | 6th |
| Wt. % aromatics in $C_5$+ | 88.8 | | | 66.7 | | | |
| Aromatics Yield, wt % of feed | 74.1 | | | 59.8 | | | |

This example shows that, in accordance with the concept of the present invention, a single externally heated conventional furnace can effectively replace a six-reactor multi-stage reactor system with catalyst disposed in the tubes of the furnace. The present invention also provides a substantially increased aromatics yield. The increase in yield results in more aromatics produced during the run. Alternatively the furnace tube reactor can be operated at lower severity allowing a much lower deactivation rate for a given yield thus allowing a run length of substantially longer than a year. We have also found the this result can be accomplished in the furnace tube reactor system of the present invention at a lower peak catalyst temperature versus the use of multi-stage adiabatic reactors with conventional furnaces preceding each of the reactor stages.

Example 2

This example compares a conventional adiabatic multi-stage reactor system to the furnace tube reactor system of the present invention. The catalyst used in this comparison is platinum on halogenated zeolite L, as disclosed in the RAULO and IKC patents cited earlier. The diameter of tubes in this example in the furnace tube reactor is larger than in the first example and the total volume of catalyst is twice as much as in the first example. The total volume of catalyst in the two compared systems is the same (1170 cubic feet). The same light naphtha is used as feed to both reactor systems. The conditions and parameters in the example have been adjusted to give the same total run length for the two systems in the comparison. The feed rate of the two systems is also the same.

| | Furnace tube | Adiabatic multi-stage reactor system | | | | | |
|---|---|---|---|---|---|---|---|
| | reactor | 1st | 2nd | 3rd | 4th | 5th | 6th |
| Tube inner diameter, inches | 4 | | | | | | |
| Number of tubes | 610 | | | | | | |
| Tube length, feet | 22 | | | | | | |
| Catalyst volume, cubic feet | 1170 | 120 | 120 | 120 | 230 | 230 | 350 |
| Temperature at reactor inlet, ° F. | 920 | 970 | 970 | 975 | 980 | 980 | 985 |
| Inlet pressure, psig | 85 | | | 85 | | | |
| Outlet pressure | 45 | | | 45 | | | |
| Liquid Hourly Space Velocity, (1/hr.) | 2.0 | | | 2.0 | | | |
| Feed | Light naphtha | | | Light naphtha | | | |

-continued

| | Furnace tube | Adiabatic multi-stage reactor system | | | | | |
|---|---|---|---|---|---|---|---|
| | reactor | 1st | 2nd | 3rd | 4th | 5th | 6th |
| $H_2$/Hydrocarbon mole ratio | 1.0 | | | 1.0 | | | |
| $C_5$+ yield, wt. % of feed | 78.9 | | | 86.4 | | | |
| Wt. % aromatics in $C_5$+ | 93.9 | | | 80.0 | | | |
| Aromatics Yield, wt % of feed | 74.1 | | | 65.1 | | | |

This example shows that for a lower activity catalyst, at a lower space velocity than the previous example, in accordance with the concept of the present invention, a single furnace reactor with catalyst disposed in the tubes of the furnace can effectively replace a six-reactor multi-stage reactor system. This example also shows that there is a substantially better aromatics yield using the Furnace reactor. The increase in yield results in more aromatics produced during the run. Alternatively the furnace tube reactor can be operated at lower severity allowing a much lower deactivation rate for a given yield thus allowing a run length of substantially longer than a year.

Example 3

In the following example, a high temperature reduced catalyst is used in an externally heated furnace tube reactor and compared to use of the same HTR catalyst in an adiabatic multi-stage reactor system.

| | Externally heated furnace tube | Adiabatic multi-stage reactor system | | | | | |
|---|---|---|---|---|---|---|---|
| | reactor | 1st | 2nd | 3rd | 4th | 5th | 6th |
| Tube inner diameter, inches | 4 | | | | | | |
| Number of tubes | 740 | | | | | | |
| Tube length, feet | 24 | | | | | | |
| Catalyst volume, cubic feet | 1550 | 150 | 150 | 150 | 320 | 320 | 460 |
| Temperature at reactor inlet, ° F. | 900 | 935 | 940 | 940 | 945 | 950 | 960 |
| Inlet pressure, psig | 85 | | | 85 | | | |
| Outlet pressure | 45 | | | 45 | | | |
| Liquid Hourly Space Velocity, (1/hr.) | 1.5 | | | 1.5 | | | |
| Feed | Light naphtha | | | Light naphtha | | | |
| $H_2$/Hydrocarbon mole ratio | 3 | | | 3 | | | |
| $C_5$+ yield, wt. % of feed | 80.1 | | | 86.5 | | | |
| Wt. % aromatics in $C_5$+ | 91.2 | | | 75.2 | | | |

This example illustrates that a six-reactor multi-stage reactor system can be effectively replaced by a system in accord with the present invention wherein catalyst is disposed in the tubes of a conventional single externally heated furnace. The catalyst used in this example is a high temperature reduced catalyst comprising Pt on L zeolite. This example also illustrates that the system of the present invention provides an increased aromatics yield. This result is accomplished at a lower peak catalyst temperature in the externally heated furnace tube reactor system than in the system comprising several furnaces and separate reactors in series.

Example 4

To determine the resistance of various substrates to coking, carburization and metal dusting under ultra low sulfur reforming conditions, the following test can be run. The test makes it especially easy to do side by side comparisons, for example comparisons with type 347 stainless steel.

The test uses a Lindberg quartz tube furnace with temperatures controlled to within one degree with a thermocouple placed on the exterior of the tube in the heated zone. The furnace tube had an internal diameter of ⅝ inches. Several preliminary test runs are conducted at an applied temperature of 1200° F. using a thermocouple suspended within the hot zone of the tube. The internal thermocouple constantly measured up to 10° F. lower than the external thermocouple.

Samples of steels and other construction materials are then tested at 1100° F., 1150° F. and 1200° F. for 24 hr, and at 1100° F. for 90 hr, under conditions that simulate the exposure of the materials under conditions of low-sulfur reforming. The samples of various materials should be clean and free of scale, grease or tarnish. Compared samples should be equally smooth. The samples are placed in an open quartz boat within the hot zone of the furnace tube. The boats are 1 by ½ inch and fit well within the two-inch hot zone of the tube. The boats are attached to silica glass rods for easy placement and removal. No internal thermocouple is used when the boats are placed inside the tube.

Prior to start-up, the test materials are cut to a size and shape suitable for ready-visual identification. After any pretreatment, such as roasting, the samples are weighed. Most samples weigh less than 300 mg. Typically, each run is conducted with three to five samples in a boat. A sample of 347 stainless steel is present in each run as an internal standard.

After the samples are placed, the tube is flushed with sulfur-free nitrogen for a few minutes. A carburizing gas of a commercially bottled mixture of 7% propane in hydrogen is bubbled through a liter flask of high purity toluene at room temperature in. order entrain about 1% toluene in the feed gas mix. This carburizing gas contains less than 10 ppb sulfur. Gas flows of 25 to 30 cc/min., and atmospheric pressure, are maintained in the apparatus. The samples are brought to operating temperatures at a rate of about 100° F./min.

After exposing the materials to the carburizing gas for the desired time and temperature, the apparatus is quenched with an air stream applied to the exterior of the tube. When the apparatus is sufficiently cool, the hydrocarbon gas is swept out with nitrogen and the boat is removed for inspection and analysis.

After completion of each run, the condition of the boat and each material is carefully noted. Typically the boat is photographed. Then, each material and its associated coke and dust is weighed to determine changes. Care is taken to keep any coke deposits with the appropriate substrate material. The samples are then mounted in an epoxy resin, ground and polished in preparation for petrographic and scanning electron microscopy analysis. The degree of surface corrosion is determined; this indicates the metal dusting and carburization response of each material. In general, a qualitative visual analysis of metal reactivities is readily made.

The residence time of the carburizing gas used in these tests is considerably higher than in typical commercial operation. Thus, it is believed that the test conditions may be more severe than commercial conditions. Nevertheless, the test provides a reliable indication of the relative resistance of the materials to carburization and metal dusting.

Example 5

Preparing Tin-Coated Steel

Pieces of 321 SS were coated with a tin-containing paint. The paint consisted of a mixture of 2 parts powdered tin oxide, 2 parts finely powdered tin (1–5 microns), 1 part stannous neodecanoate in neodecanoic acid (20% Tin Tem-Cem manufactured by Mooney Chemical Inc., Cleveland, Ohio which contained 20% tin as stannous neodecanoate) mixed with isopropanol, as described in U.S. Pat. No. 5,674,376. The coating was applied to the steel surface by painting and letting the paint dry in air. After drying, the painted steel was contacted with flowing hydrogen gas at 1100° F. for 24 hours.

The resulting coated steel specimens with intermetallic tin layers were examined visually for completeness of coating. Also, mounted and polished cross-sections of the materials when examined using petrographic and scanning electron microscopy. The micrographs showed that the tin paint had reduced to metallic tin under these conditions. A continuous and adherent metallic (iron/nickel stannide) protective layer was observed on the steel surface.

These techniques showed that tin intermetallic compounds, including nickel- and iron-containing stannides, were present at a thickness of between about 2 to 5 microns. A nickel-depleted underlayer of a thickness of about 2–5 microns was also present. If the curing was done at lower temperature, this underlayer was not formed.

Example 6

Analysis of Steel

Samples of coated and preferably heat cured steels were mounted in a clear epoxy resin and then ground and polished in preparation for analysis with the petrographic and scanning electron microscopes (SEM). Coupons were analyzed before and after reforming conditions. EDX analysis can be used to determine the chemical composition of the layers. For example, tin intermetallic layers may be analyzed for iron, nickel and tin.

Example 7

Determination of the Deactivation Rate of a Catalyst

Deactivation rate of a catalyst sample as used in the present invention can be determined in an isothermal pilot plant or similar unit under the following standard conditions using a standard feed.

The feed to the unit should be a C6–C7 UDEX raffinate from a conventional reformer. The UDEX raffinate feed should have the following composition as measured by Gas Chromatograph; a C6 paraffin content of 39 to 43 wt %, a total C6 content of 45 to 50 wt %, a total C7 content of 25 to 35 wt %, a total C5 content of 5 to 11 wt %, and a total C8 content of less than 6 wt %. The feed should contain less than 10 ppb of sulfur and less than 3 ppm of water. The pilot plant should also be free of any other possible source of sulfur contamination. Care must be taken to avoid sulfur contamination of the system and to avoid using a previously sulfur contaminated system. Two patents that teach how to clean-up a sulfur contaminated system are U.S. Pat. Nos. 5,035,792 and 4,940,532 both of which are herein incorporated by reference. The LHSV of the unit should be set at 4 (1/hr) with a system pressure of 85 psig. The hydrogen/hydrocarbon mole ratio of the system should be 2. The pilot plant unit should be operated at a temperature sufficient to maintain the aromatics in the reactor effluent at 50 wt %. The temperature is increased to maintain the 50 wt % aromatics and the results plotted over a 8 week period (1344 hours) of continuous stable operation under said conditions. The fouling rate can be determined for the period of stable operation by dividing the change in temperature over the period by the number of hours.

What is claimed is:

1. A process for catalytic reforming of feed hydrocarbons to form aromatics, comprising contacting the feed, under catalytic reforming conditions, with catalyst disposed in the tubes of a furnace, wherein the catalyst is a monofunctional, non-acidic catalyst and comprises a Group VIII metal and zeolite L, and wherein the furnace tubes are from 2 to 8 inches in inside diameter, and wherein the furnace tubes are heated, at least in part, by gas or oil burners located outside the furnace tubes.

2. A process for catalytic reforming of hydrocarbons comprising: passing hydrocarbons over a catalyst comprising a Group VIII metal and zeolite L disposed within a furnace; wherein said furnace comprises a first chamber and a second adjoining chamber separated by a heat exchange surface; wherein said catalyst is located within said first chamber and one or more gas or oil burners are located within said second chamber; and wherein the catalyst is no more than 4 inches from the heat exchange surface and at least a portion of said catalyst is more than one inch from said heat exchange surface.

3. The process of claim 1 wherein the catalyst under said reforming conditions has a deactivation rate of less than 0.04 degrees F per hour.

4. The process of claim 2 wherein the catalyst under said reforming conditions has a deactivation rate of less than 0.04 degrees F per hour.

5. A process in accordance with claim 1 wherein the furnace tubes are 3 to 6 inches in diameter.

6. The process of claim 2 wherein the catalyst is no more than 3 inches from the heat exchange surface and at least a portion of said catalyst is more than 1.5 inches from said heat exchange surface.

7. A process in accordance with claims 1 or 2 wherein the catalytic reforming conditions include a LHSV of 1.0 to 7.

8. A process in accordance with claims 1 or 2 wherein the catalytic reforming conditions include a hydrogen to hydrocarbon mole ratio of between 0.5 and 3.0.

9. A process in accordance with claims 1 or 2 wherein the Group VIII metal is platinum.

10. A process in accordance with claims 1 or 2 wherein the catalyst is produced by steps comprising treatment in a gaseous environment in a temperature range between 1025° F. and 1275° F. while maintaining the water level in the effluent gas below 1000 ppm.

11. A process in accordance with claim 10 wherein the water level is below 200 ppm.

12. A process in accordance with claims 1 or 2 wherein the catalyst contains at least one halogen in an amount between 0.1 and 2.0 wt. % based on zeolite L.

13. A process in accordance with claim 12 wherein the halogens are fluorine and chlorine and are present on the catalyst in an amount between 0.1 and 1.0 wt. % fluorine and 0.1 and 1.0 wt. % chlorine at the start of run.

14. A process in accordance with claims 1 or 2 wherein the feed contains less than 50 ppb sulfur.

15. A process in accordance with claim 13 wherein the feed contains less than 10 ppb sulfur.

16. A process in accordance with claims 1 or 3 wherein the catalytic reforming conditions include a LHSV between 3 and 5, a hydrogen to hydrocarbon ratio between 1 and 1.5, a furnace tube interior temperature between 600° F. and 960° F. at the inlet and between 860° F. and 1025° F. at the outlet at SOR and between 600° F. and 1025° F. at the inlet and between 920° F. and 1025° F. at the outlet at EOR, and an outlet pressure of between 35 and 75 psig.

17. A process in accordance with claims 1 or 3 wherein said furnace tubes are made of a material having a resistance to carburization and metal dusting under low sulfur reforming conditions at least as great as that of type 347 stainless steel.

18. A process in accordance with claims 2 or 4 wherein said first chamber is made of a material having a resistance to carburization and metal dusting under low sulfur reforming conditions at least as great as that of type 347 stainless steel.

19. A process in accordance with claims 1 or 3 wherein:

(a) said furnace tubes are made of type 347 stainless steel or a steel having a resistance to carburization and metal dusting at least as great as type 347 stainless steel; or (b) said furnace tubes have been treated by a method comprising plating, cladding, painting or coating the furnace tube surfaces for contacting the feed to provide improved resistance to carburization and metal dusting; or (c) said furnace tubes are constructed of or lined with a ceramic material.

20. A process in accordance with claims 2 or 4 wherein:

(a) said first chamber is made of type 347 stainless steel or a steel having a resistance to carburization and metal dusting at least as great as type 347 stainless steel; or (b) said first chamber has been treated by a method comprising plating, cladding, painting or coating the first chamber surfaces for contacting the feed to provide improved resistance to carburization and metal dusting; or (c) said first chamber is constructed of or lined with a ceramic material.

21. A process in accordance with claim 2 wherein the catalytic reforming conditions include a LHSV between 3 and 5, and a hydrogen to hydrocarbon ratio between 1.0 and 1.5.

22. The process of claims 1 or 2 wherein the catalyst under said reforming conditions has a deactivation rate of less than 0.03 degrees F per hour.

23. The process of claims 1 or 2 wherein the deactivation rate is less than 0.02 degrees F per hour.

24. The process of claims 1 or 2 wherein the deactivation rate is less than 0.01 degrees F per hour.

* * * * *